US011473740B2

(12) United States Patent
Liu et al.

(10) Patent No.: US 11,473,740 B2
(45) Date of Patent: Oct. 18, 2022

(54) LIGHTING FIXTURE

(71) Applicant: OPPLE LIGHTING CO., LTD., Shanghai (CN)

(72) Inventors: Chaobo Liu, Shanghai (CN); Lei Yan, Shanghai (CN); Hongbo Wang, Shanghai (CN)

(73) Assignee: Opple Lighting Co., Ltd., Shanghai (CN)

( * ) Notice: Subject to any disclaimer, the term of this patent is extended or adjusted under 35 U.S.C. 154(b) by 0 days.

(21) Appl. No.: 17/137,655

(22) Filed: Dec. 30, 2020

(65) Prior Publication Data

US 2021/0116081 A1 Apr. 22, 2021

Related U.S. Application Data

(63) Continuation of application No. PCT/CN2019/112367, filed on Oct. 21, 2019.

(30) Foreign Application Priority Data

Oct. 24, 2018 (CN) ..... 201811244036.9
Oct. 24, 2018 (CN) ..... 201811244062.1
Oct. 24, 2018 (CN) ..... 201821732703.3

(51) Int. Cl.
*F21S 4/28* (2016.01)
*F21V 3/00* (2015.01)
(Continued)

(52) U.S. Cl.
CPC ..... *F21S 4/28* (2016.01); *F21V 3/00* (2013.01); *F21V 17/164* (2013.01);
(Continued)

(58) Field of Classification Search
CPC .. F21V 17/164; F21V 19/0045; F21V 21/088; F21V 3/00; F21V 3/049; F21V 23/04; F21S 4/28; F21S 8/08
See application file for complete search history.

(56) References Cited

U.S. PATENT DOCUMENTS 5,081,568 A * 1/1992 Dong ..... F21L 4/02 362/184
5,622,423 A * 4/1997 Lee ..... F21V 23/0414 362/186
(Continued)

FOREIGN PATENT DOCUMENTS

CN 201335329 Y 10/2009
CN 201696998 U 1/2011
(Continued)

OTHER PUBLICATIONS

International Search Report (including English translation) and Written Opinion issued in PCT/CN2019/112367, dated Dec. 25, 2019, 13 pages.

*Primary Examiner* — Arman B Fallahkhair
(74) *Attorney, Agent, or Firm* — Arch & Lake LLP

(57) ABSTRACT

A lighting fixture is provided. The lighting fixture includes a support column including a top end, a bottom end, and a side wall between the top end and the bottom end; a first light source module assembled on an outer side of the side wall of the support column, including a substrate and a plurality of columns of first light sources on the substrate and arranged along a circumferential direction of the support column, and each column of first light sources extending along a direction from the top end to the bottom end of the support column; and a face mask covering an outer side of the first light source module. The plurality of columns of first light sources are configured to emit light laterally toward the
(Continued)

face mask, and a maximum light-emitting surface of each column intersects an adjacent column on the face mask.

20 Claims, 15 Drawing Sheets

(51) Int. Cl.

| | |
|---|---|
| ***F21V 17/16*** | (2006.01) |
| ***F21V 21/088*** | (2006.01) |
| ***F21V 23/04*** | (2006.01) |
| ***F21Y 107/30*** | (2016.01) |
| ***F21Y 115/10*** | (2016.01) |

(52) U.S. Cl.
CPC ..... *F21V 21/088* (2013.01); *F21V 23/04* (2013.01); *F21Y 2107/30* (2016.08); *F21Y 2115/10* (2016.08)

(56) References Cited

U.S. PATENT DOCUMENTS

| | | | | | |
|---|---|---|---|---|---|
| 5,688,042 | A * | 11/1997 | Madadi | G09F 13/04 | 362/240 |
| 5,890,794 | A * | 4/1999 | Abtahi | F21V 23/00 | 362/294 |
| 5,899,557 | A * | 5/1999 | McDermott | F21V 5/046 | 362/244 |
| 6,905,228 | B1 * | 6/2005 | Takeyasu | F21V 19/0055 | 362/237 |
| 7,014,337 | B2 * | 3/2006 | Chen | F21V 19/001 | 362/240 |
| 7,267,453 | B2 * | 9/2007 | Chang | A45B 3/04 | 361/232 |
| 8,220,956 | B2 * | 7/2012 | Lai | F21K 9/27 | 362/218 |
| 9,217,542 | B2 * | 12/2015 | Pickard | F21V 29/71 | |
| 9,879,581 | B2 * | 1/2018 | Rodman | F01N 3/103 | |
| 10,451,263 | B2 * | 10/2019 | Lan | F21K 9/237 | |
| 10,502,407 | B1 * | 12/2019 | Spiro | H05B 47/125 | |
| 11,022,258 | B2 * | 6/2021 | Deng | F21K 9/232 | |
| 11,105,474 | B2 * | 8/2021 | Liu | F21V 7/0091 | |
| 11,118,777 | B2 * | 9/2021 | Wu | F21K 9/237 | |
| 2007/0159828 | A1 * | 7/2007 | Wang | F21V 29/763 | 362/294 |
| 2011/0156584 | A1 * | 6/2011 | Kim | F21K 9/232 | 315/32 |
| 2011/0254423 | A1 * | 10/2011 | Lee | F21K 9/232 | 313/46 |

FOREIGN PATENT DOCUMENTS

| | | | |
|---|---|---|---|
| CN | 201706247 | U | 1/2011 |
| CN | 204573724 | U | 8/2015 |
| CN | 109323173 | A | 2/2019 |
| CN | 109442265 | A | 3/2019 |
| CN | 208764880 | U | 4/2019 |
| WO | 2009150574 | A1 | 12/2009 |

* cited by examiner

LIGHTING FIXTURE

CROSS-REFERENCE TO RELATED APPLICATIONS

This application is based upon and claims the priority of PCT patent application No. PCT/CN2019/112367 filed on Oct. 21, 2019 which claims priority to the Chinese patent application No. 201811244062.1 filed on Oct. 24, 2018 and the Chinese patent application No. 201811244036.9 filed on Oct. 24, 2018 and the Chinese patent application No. 201821732703.3 filed on Oct. 24, 2018, the entire content of all of which is hereby incorporated by reference herein for all purposes.

TECHNICAL FIELD

The present disclosure relates to the field of lighting technology, in particular to a lighting fixture.

BACKGROUND

As an application range of a lighting fixture continues to expand, the types of the lighting fixture are increasing. Taking an outdoor light as an example, there are a beam light, a spotlight, a project light, and the like. However, currently, all lighting fixtures form an outward luminous beam at a top end of the lighting fixture, so that the lighting style of the lighting fixture is relatively simple and cannot effectively meet usage requirements.

SUMMARY

The present disclosure provides a lighting fixture.

The lighting fixture of the present disclosure includes a support column comprising a top end, a bottom end, and a side wall between the top end and the bottom end; a first light source module assembled on an outer side of the side wall of the support column, comprising a substrate and a plurality of columns of first light sources on the substrate and arranged along a circumferential direction of the support column, and each column of first light sources extending in a direction from the top end to the bottom end of the support column; and a face mask covering and arranged on an outer side of the first light source module, wherein the plurality of columns of first light sources are configured to emit light laterally toward the face mask, and a maximum light-emitting surface of each column of first light sources on the face mask at least intersects with projections of normal lines of adjacent columns of first light sources on the face mask.

The present disclosure further provides a lighting fixture, which may include: a support column comprising a top end, a bottom end, and a side wall between the top end and the bottom end; a first light source module assembled on an outer side of the side wall of the support column and configured to emit light laterally; a face mask covering and arranged on an outer side of the first light source module; and a second light source module assembled on the top end of the support column and configured to emit a light beam extending outward along an axis of the support column.

It is to be understood that both the foregoing general description and the following detailed description are exemplary and explanatory only and are not restrictive of the present disclosure.

BRIEF DESCRIPTION OF THE DRAWINGS

The drawings described here are used to provide a further understanding of the present disclosure and constitute a part of the present disclosure. The illustrative examples of the present disclosure and the description thereof are used to explain the present disclosure and do not constitute an improper limitation of the present disclosure. In the drawings.

DETAILED DESCRIPTION

Figure 1:
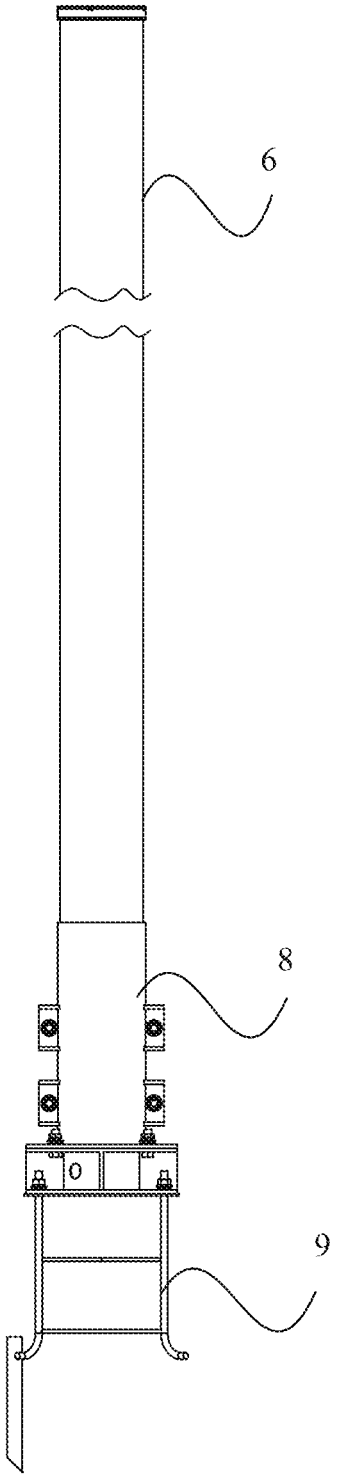
FIG. 1 is a structural schematic diagram of a lighting fixture provided by an example of the present disclosure.

The technical solutions of the present disclosure are described in conjunction with examples of the present disclosure and the corresponding drawings. The described examples are only a part of the examples of the present disclosure, rather than all the examples. Based on the examples in the present disclosure, all other examples obtained by a person of ordinary skill in the art without creative work fall within the protection scope of the present disclosure.

It shall be understood that, although the terms "first," "second," "third," and the like may be used herein to describe various information, the information should not be limited by these terms. These terms are only used to distinguish one category of information from another. For example, without departing from the scope of the present disclosure, first information may be termed as second information; and similarly, second information may also be termed as first information. As used herein, the term "if" may be understood to mean "when" or "upon" or "in response to" depending on the context.

Description of reference numerals used in this disclosure may include:

Support Column—1; Connection Sleeve—2; Light Source board—3; Light-Shielding board—3'; First Light Source Module—4; Second Light Source Module—5; Face Mask—6; Sealing Cover—7; lampstand—8; Embedded Member—9; Rubber Pad—101; Switch—102; Drive—103; Top End—11; Bottom End—12; Sidewall—13; Snap—fit portion—14; Threaded Hole—15; Fixing Groove—16; Convex Edge—21; Substrate—41; First Light Source—42; Diffuser—43; Housing—51; Second Light Source—52; Beam Expanded Lens—53; Collimating Lens—54; Fixing Base—81; Clamping Base—82; Clamping Lug—141; Clamping Slot—142; Normal Line—421; Maximum Light—Emitting Surface—422; First Housing Part—511; and Second Housing Part—512.

Figure 2:
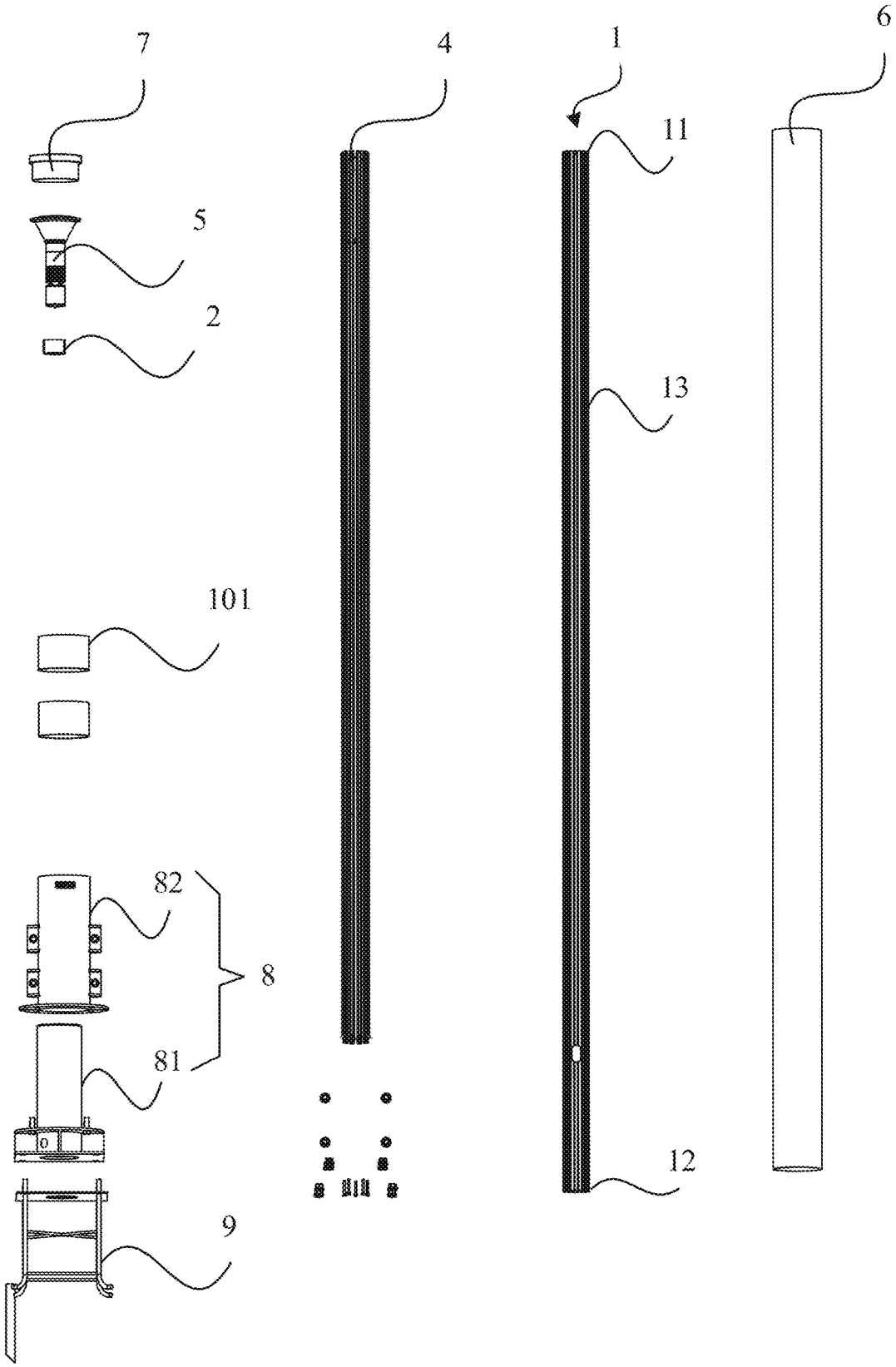
FIG. 2 is a schematic diagram of an exploded structure of a lighting fixture provided by an example of the present disclosure.
Figure 10:
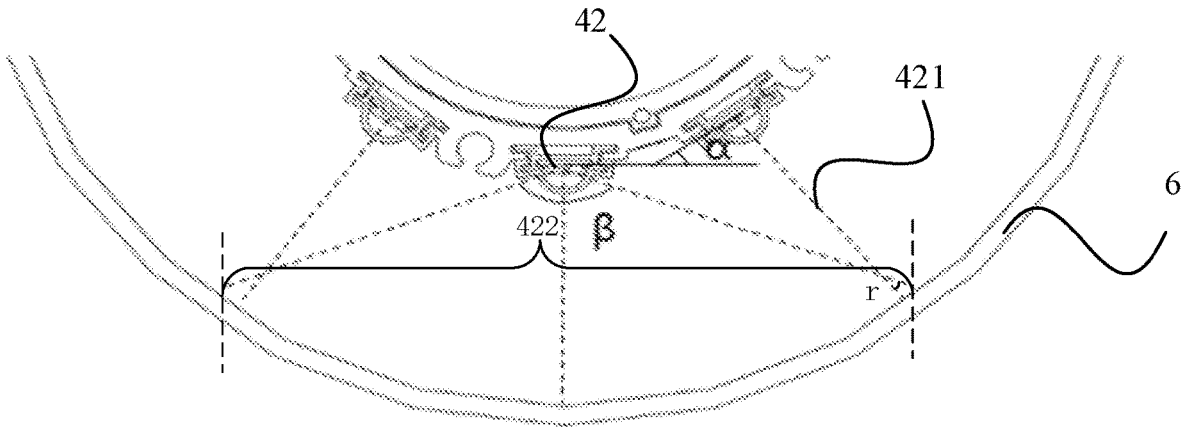
FIG. 10 is a diagram of a positional relationship between respective first light sources provided by an example of the present disclosure.

As shown in FIGS. 1 and 2, a lighting fixture of the present application includes a support column 1, a first light source module 4 arranged on the support column 1, and a face mask 6 covering an outer side of the first light source module 4, respectively. The support column 1 includes a top end 11, a bottom end 12, and a side wall 13 located between the top end 11 and the bottom end 12. The first light source module 4 is assembled on an outer side of the side wall 13. The first light source module 4 includes a substrate 41 and a first light source 42 arranged on the substrate 41. A plurality of columns of first light sources 42 are arranged along a circumferential direction of the support column 1. Each column of first light sources 42 extend along a direction from the top end 11 to the bottom end 12 of the support column 1 to emit light laterally toward the face mask 6. As shown in FIG. 10, a maximum light-emitting surface 422 of each column of first light sources 42 on the face mask 6 at least intersects with a projection of a normal line 421 of an adjacent column of first light sources 42 on the face mask 6.

Through the foregoing arrangement, the lighting fixture may form a uniform side light emission according to needs, and increase a light-emitting pattern of the lighting fixture, so as to better meet the use demand, and the lighting fixture has a simple structure, convenient disassembly and assembly, and low cost.

A maximum range of angle r at which the maximum light-emitting surface 422 intersects with the projection may not exceed 5 degrees to reduce an amount of columns of the first light sources 42, and the intersection angle r is relatively small, which may reduce the width under the brightness and further improve light uniformity.

As shown in FIGS. 1 and 2, the outdoor lighting fixture of the present disclosure may also include a support column 1, and a first light source module 4, a face mask 6 and a second light source module 5 respectively arranged on the support column 1. The support column 1 includes a top end 11, a bottom end 12, and a side wall 13 located between the top end 11 and the bottom end 12. The first light source module 4 is assembled on the outer side of the side wall 13 and configured to emit light laterally. The face mask 6 is arranged on the outer side of the first light source module 4. The second light source module 5 is assembled on the top end 11 of the support column 1 and configured to emit a light beam extending outward along an axis of the support column 1. Both the side wall 13 and the top end 11 of the support column 1 are provided with the light source modules. The side light emission and the light beam extending outward along the axis of the support column 1 may be formed according to needs, which increases a light-emitting pattern of the lighting fixture, so as to better meet use demand. Further, the lighting fixture has a simple structure, convenient disassembly and assembly, and low cost.

In order to achieve the above objectives, respective components of the lighting fixture may be arranged in a variety of ways. The following uses examples to describe a structure of each component in detail.

Figure 3:
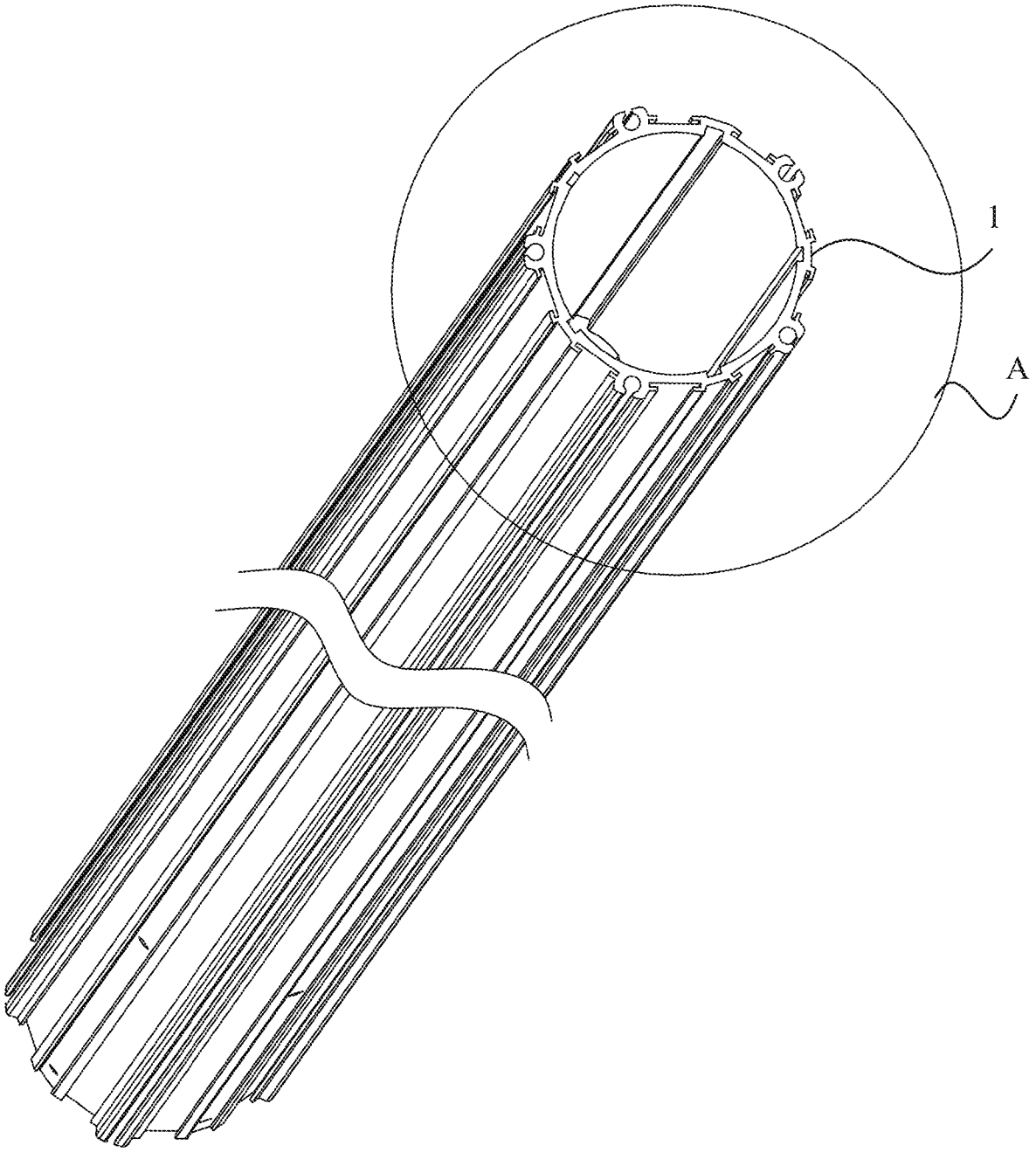
FIG. 3 is a structural schematic diagram of a support column provided by an example of the present disclosure.
Figure 4:
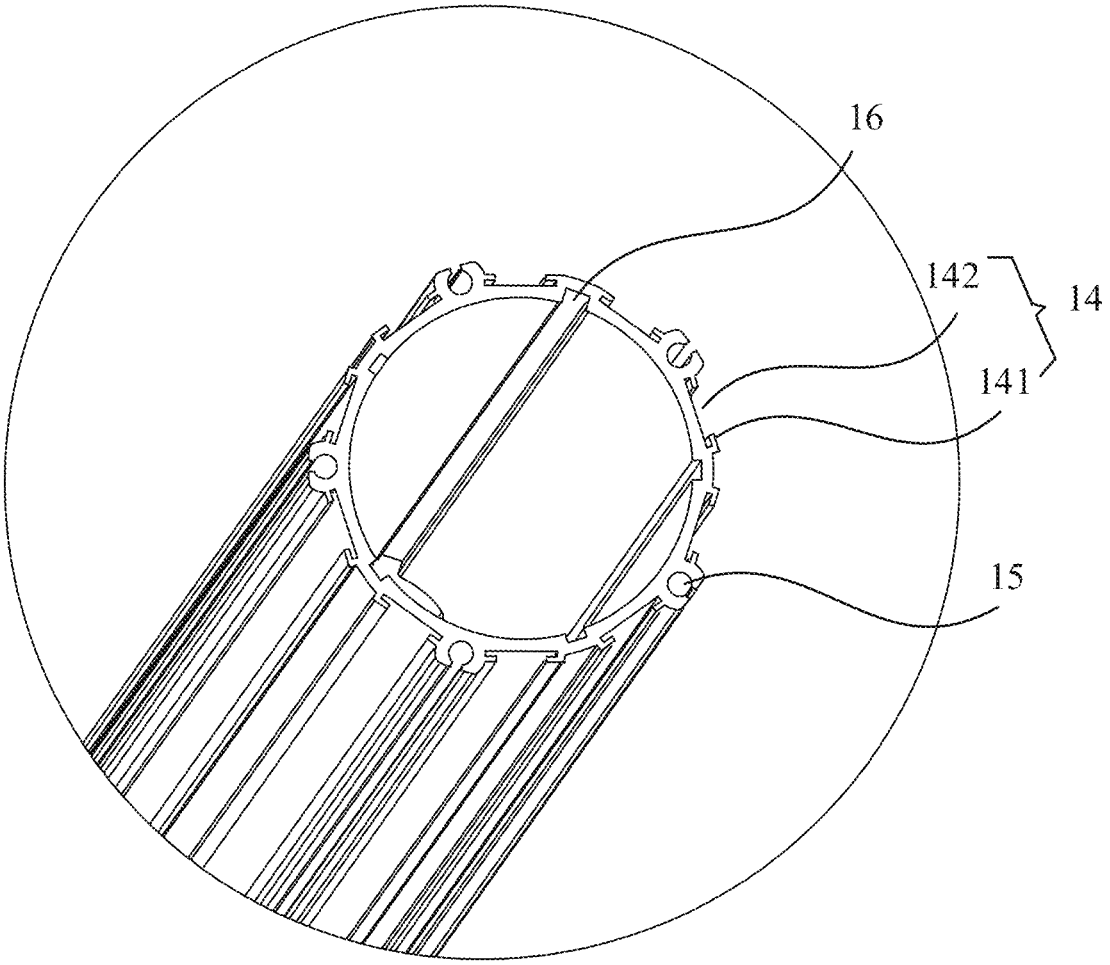
FIG. 4 is an enlarged diagram of part A of FIG. 3.

The support column 1 may ensure a straightness of the lighting fixture and reduce the possibility of bending and deformation of the lighting fixture. As shown in FIGS. 3 and 4, the support column 1 is substantially cylindrical, and a middle of the support column is a through hole that penetrates the top end 11 and the bottom end 12 of the support column 1 to reduce the weight of the lighting fixture. A material, a wall thickness, a length, a diameter and the like of the support column 1 may be set according to requirements.

A snap-fit portion 14 extending from a top end 11 to a bottom end 12 of the support column 1 is provided on the outer side of the side wall 13 of the support column 1. The snap-fit portion 14 is configured to fix the first light source module 4. The snap-fit portion 14 may be a clamping slot 142 with a clamping lug 141 on both sides of the clamping slot 142. The first light source module 4 is inserted into the clamping slot 142 from one end of the clamping slot 142 and fixed by the clamping lug 141. A plurality of snap-fit portions 14 are provided along the circumferential direction of the support column 1. Respective snap-fit portions 14 fixe different first light source modules 4.

A fixing groove 16 is provided on an inner side of the side wall 13 of the support column 1 and located at the top end 11. The side wall 13 of the support column 1 is recessed toward the outer side to form the fixing groove 16. The fixing groove 16 extends along an axial direction of the support column 1, and the plurality of fixing grooves 16 are provided at an interval along the circumferential direction of the support column 1.

Figure 8:
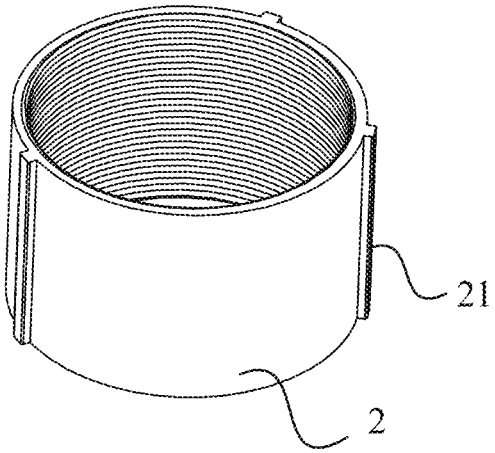
FIG. 8 is a structural schematic diagram of a connection sleeve provided by an example of the present disclosure.

The fixing groove 16 is configured to assist in positioning a connection sleeve 2 of the lighting fixture to improve installation convenience of the connection sleeve 2. An outer side of the connection sleeve 2 is provided with a convex edge 21 located in the fixing groove 16 (as shown in FIG. 8). When mounting the connection sleeve 2, the fixing groove 16 is first configured to assist in positioning the connection sleeve 2. The connection sleeve 2 is placed in the support column 1 and then fixes the connection sleeve 2 via a screw on the side. An inner side of the connection sleeve 2 is provided with threads. The second light source module 5 is screwed on the connection sleeve 2 to realize the fixing of the second light source module 5.

The first light source module 4 forms the side light emission around the side wall 13 of the support column 1. A plurality of groups of first light source modules 4 are provided along the circumferential direction of the support column 1. Each group of the first light source module 4 has the same structure, and different first light source modules 4 are locked in different snap-fit portions 14 to facilitate processing and assembly of the first light source module 4. Each first light source module 4 includes the substrate 41 and the first light source 42 fixed on the substrate 41.

Figure 5:
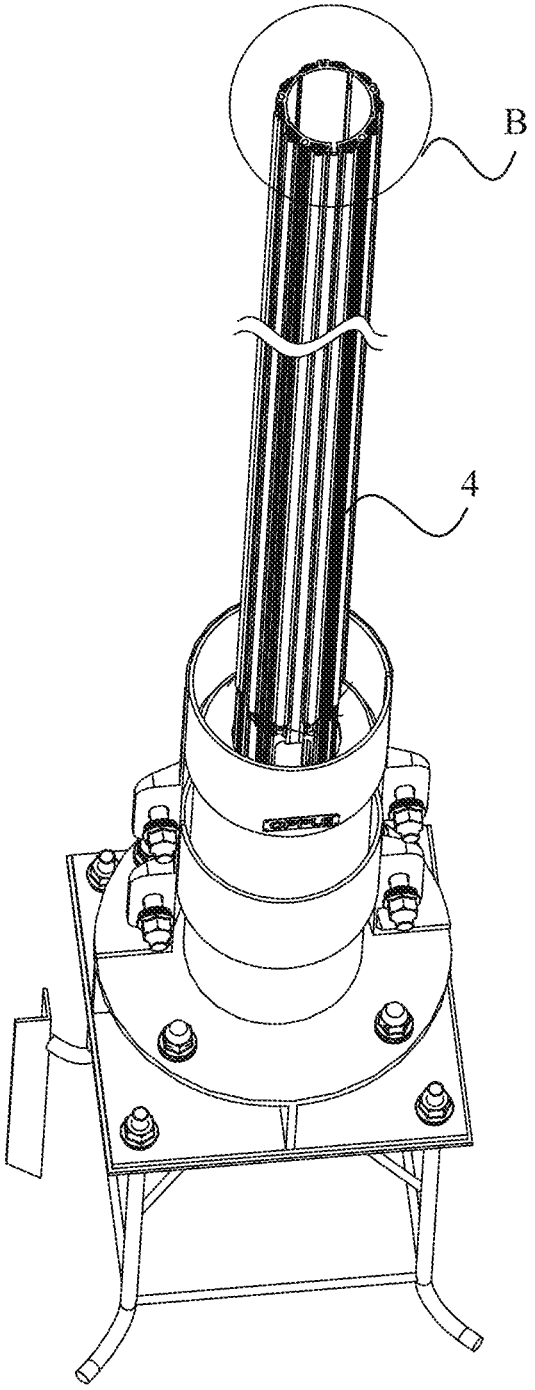
FIG. 5 is a structural schematic diagram of a first light source module mounted on a support column provided by an example of the present disclosure.
Figure 6:
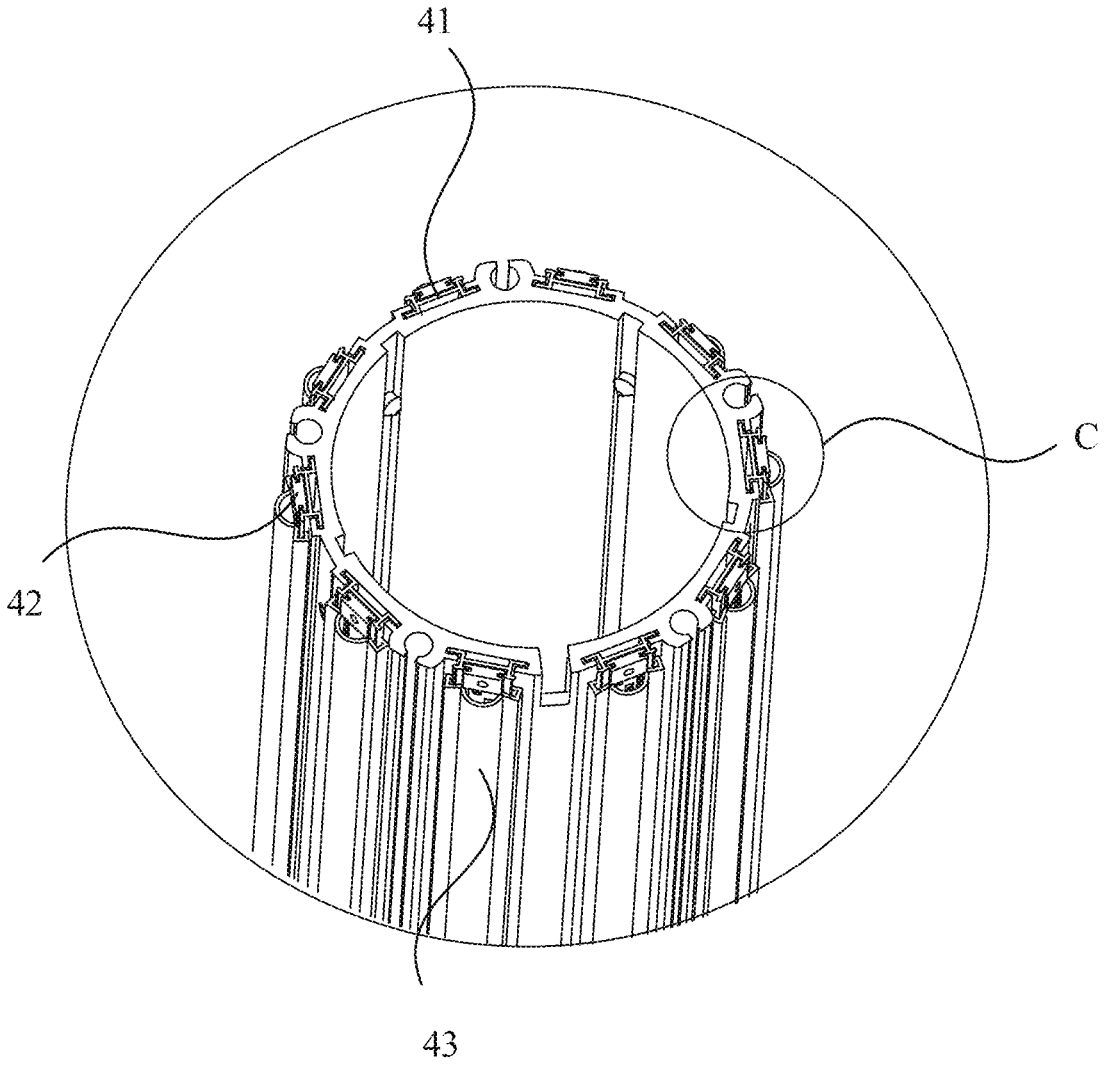
FIG. 6 is an enlarged diagram of part B of FIG. 5.
Figure 7:
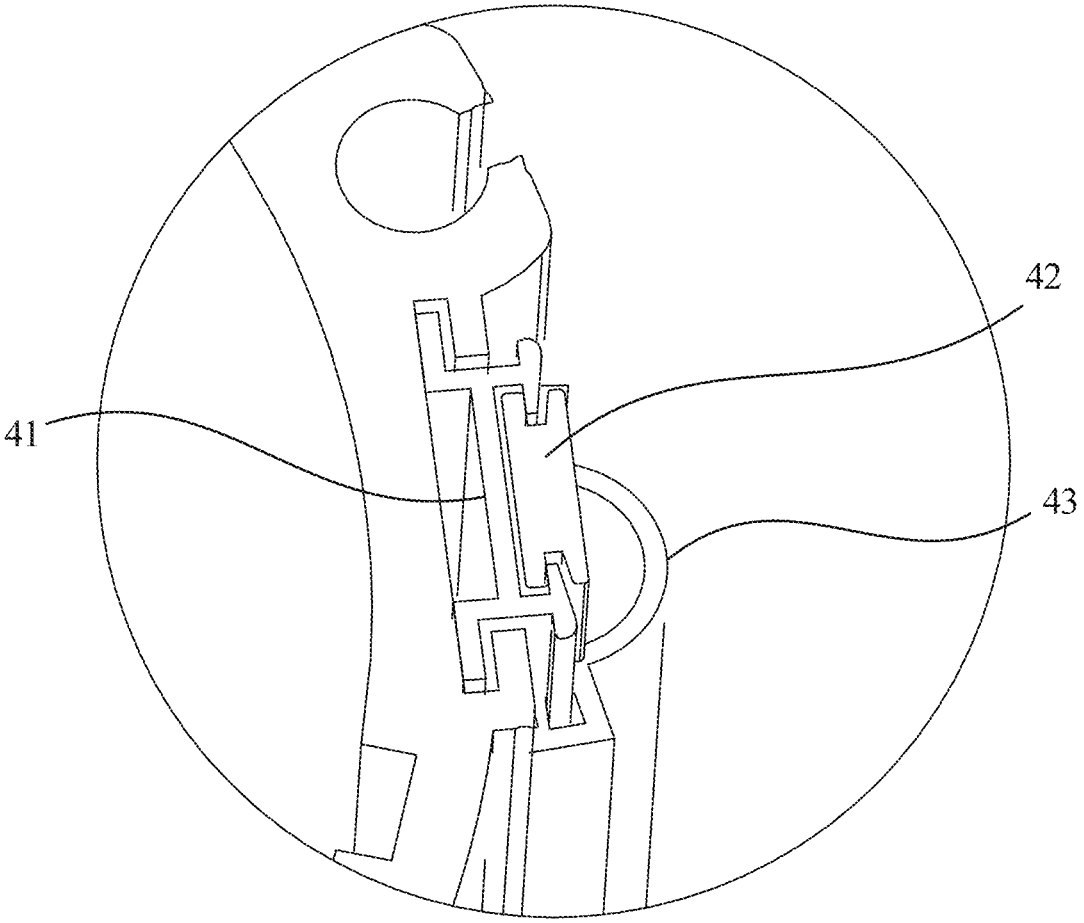
FIG. 7 is an enlarged diagram of part C of FIG. 6.

The first light source module 4 may be arranged in a variety of ways. In a first example, as shown in FIGS. 5-7, the substrate 41 is substantially planar. After the substrate 41 is mounted on the support column 1, the substrate 41 extends along a direction from the top end 11 to the bottom end 12 of the support column. The substrate 41 may have a length slightly smaller than a length of the support column 1. After the substrate 41 is mounted on the support column 1, the top end of the substrate 41 is flush with the top end 11 of the support column 1. The bottom end of the substrate 41 is misaligned with the bottom end 12 of the support column 1 so that the bottom end of the support column 1 reserves an installation space of the lampstand 8. This arrangement has the advantages of a simple structure, convenient assembly, labor-saving and low cost. Of course, the substrate 41 may also be an FPC substrate 41 that may be bent, and the substrate 41 is bent into a curved shape around the support column 1.

A plurality of substrates 41 are provided along the circumferential direction of the support column 1. Structures of respective substrate 41 are the same. The first light source 42 may be an LED (Light Emitting Diode, LED) light source. The plurality of first light sources 42 are arranged at an interval on each substrate 41. The plurality of first light sources 42 are arranged into one column from the top end 11 to the bottom end 12 of the support column 1. Because the substrate 41 is planar, the plurality of first light sources 42 on the same substrate 41 is arranged in a planar shape. This arrangement has the advantages of a simple structure, convenient assembly, labor-saving, and low cost.

The first light source module 4 may further include an optical element 43. The optical element may be a diffuser, a lens, a reflector, or the like. The optical element 43 extends in the direction from the top end 11 to the bottom end 12 of the support column 1. The optical element 43 forms a light diffusing along the circumferential direction of the support column 1. Taking the optical element 43 as a diffuser as an example, the diffuser has a length approximately the same as that of the substrate 41. A middle of the diffuser is an arc surface extending from one end to the other end of the diffuser, so that the diffused light formed by the diffuser is along the circumferential direction of the support column 1. A diffuser may be clamped and arranged on the substrate 41. This arrangement improves the uniformity of side light emission, has a simple structure, is convenient to assemble, and saves time and effort.

Figure 9:
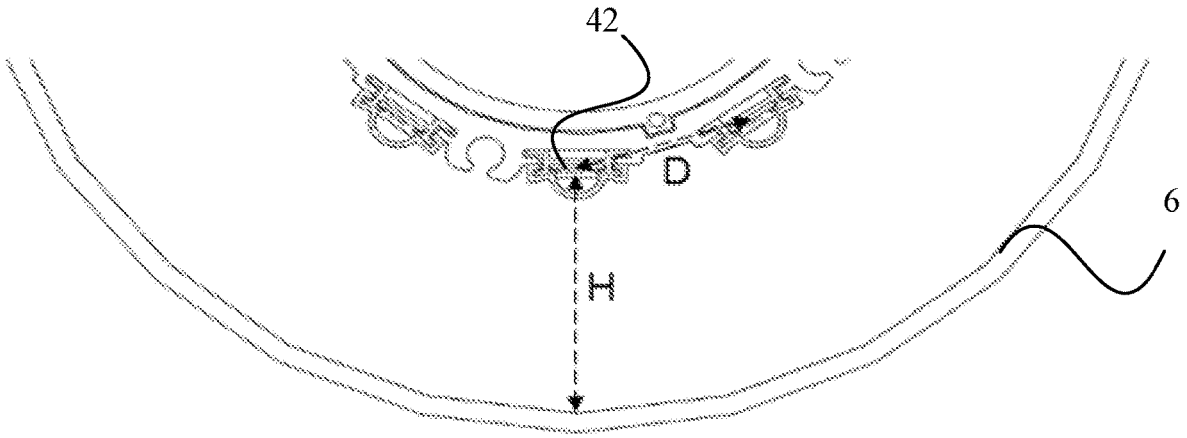
FIG. 9 is a diagram of a positional relationship between a first light source and a face mask provided by an example of the present disclosure.

When the lighting fixture needs to form uniform side light emission, as shown in FIGS. 9 and 10, a distance between normal lines 421 two adjacent groups (the first light sources 42 located on the same substrate 41 is called one group) of first light sources 42 is denoted as D, and a distance between the normal line 421 of the first light source 42 and the face mask 6 is denoted as H, then $H \geq 1.4D$. A deflection angle of the two adjacent groups of first light sources 42 is denoted as $\alpha$, and a light-emitting angle of each group of first light sources 42 is denoted as $\beta$, then $\beta \geq 120° + \alpha$. In this way, the light-emitting angle $\beta$ of the first light source 42 may cover intersection points of normal lines 421 of two adjacent groups of first light sources 42 and the face mask 6. When the uniform side light emission is formed, arrangement and installation of the substrate 41 are also convenient.

Of course, in other arrangement examples of the first light source module 4, a difference from the first example is that the substrate 41 may also be the FPC substrate 41 that may be bent. The substrate 41 is bent into a ring shape around the support column 1. The substrate 41 may be a whole. The plurality of columns of first light sources 42 are arranged on the substrate 41 at an interval.

The first light source module 4 may also include the optical element 43. The optical element 43 may be covered by each column of the first light sources 42. The optical element 43 extends in the direction from the top end 11 to the bottom end 12 of the support column 1. For example, the optical element 43 may form the diffused light along the circumferential direction of the support column 1. The optical element 43 may be a diffuser, a lens, a reflector, and the like. Taking the optical element 43 as the diffuser as an example, the diffuser has a length approximately the same as a length of the substrate 41. A middle of the diffuser is an arc surface extending from one end to the other end of the diffuser, so that the diffused light formed by the diffuser is along the circumferential direction of the support column 1. The diffuser may be clamped on the substrate 41. This arrangement improves the uniformity of the side light emission, has a simple structure, is convenient to assemble, and saves time and effort.

A person of ordinary skill in the art knows that the light-emitting angle $\beta$ of the first light source 42 after the optical element 43 is provided is the light-emitting angle $\beta$ after the optical element 43 is added.

As shown in FIG. 1, the face mask 6 is approximately cylindrical and sleeved on the outer side of the first light source module 4. The face mask 6 has a length longer than a length of the support column 1. After the face mask 6 is sleeved on the outer side of the support column 1, the bottom end 12 of the face mask 6 is substantially flush with the bottom end 12 of the support column 1. The top end of the face mask 6 protrudes from the support column 1, so as to facilitate the top end 11 of the support column 1 to be provided with the second light source module 5.

The arrangement of the support column 1 may ensure the straightness of the lighting fixture and reduce the possibility of bending and deformation of the lighting fixture. As shown in FIGS. 3 and 4, the support column 1 is substantially cylindrical, and the middle of the support column is a through hole that penetrates the top end 11 and the bottom end 12 of the support column 1 to reduce the weight of the lighting fixture. The material, the wall thickness, the length, the diameter and the like of the support column 1 may be set according to requirements.

When the substrate 42 is planar, the side wall 13 of the support column 1 is provided with the snap-fit portion 14 extending from the top end 11 to the bottom end 12 of the support column 1. The snap-fit portion 14 is configured to fix the substrate 42. The snap-fit portion 14 may be a clamping slot 142 with the clamping lug 141 on both sides of the clamping slot 142. The substrate 42 is inserted into the clamping slot 142 from one end of the clamping slot 142 and fixed by the clamping lug 141 to facilitate processing and assembly of the substrate 42. The plurality of snap-fit portions 14 are provided along the circumferential direction of the support column 1, and respective snap-fit portions 14 fixe different substrates 42.

The fixing groove 16 is provided on the inner side of the side wall 13 of the support column 1 and located at the top end 11. The side wall 13 of the support column 1 is recessed toward the outer side to form the fixing groove 16. The fixing groove 16 extends along the axial direction of the support column 1, and the plurality of fixing grooves 16 are provided at an interval along the circumferential direction of the support column 1.

The fixing groove 16 is configured to assist in positioning the connection sleeve 2 of the lighting fixture, and improving the installation convenience of the connection sleeve 2. The outer side of the connection sleeve 2 is provided with a convex edge 21 in the fixing groove 16 (as shown in FIG. 8). When installing the connection sleeve 2, the fixing groove 16 is first configured to assist in positioning the connection sleeve 2. The connection sleeve 2 is placed in the support column 1 and then fixes the connection sleeve 2 via the screw on the side. The inner side of the connection sleeve 2 is provided with the threads. The second light source module 5 may be provided on the top end 11 of the support column 1. The second light source module 5 is screwed on the connection sleeve 2 to realize the fixing of the second light source module 5.

Figure 11:
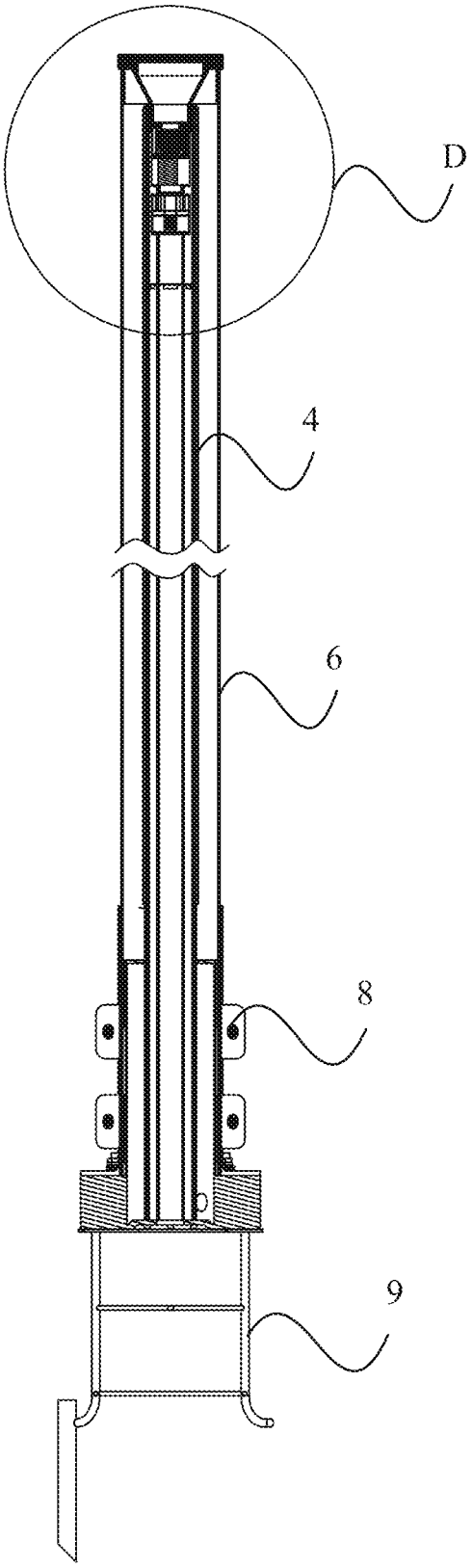
FIG. 11 is a cross-sectional diagram of FIG. 1.
Figure 12:
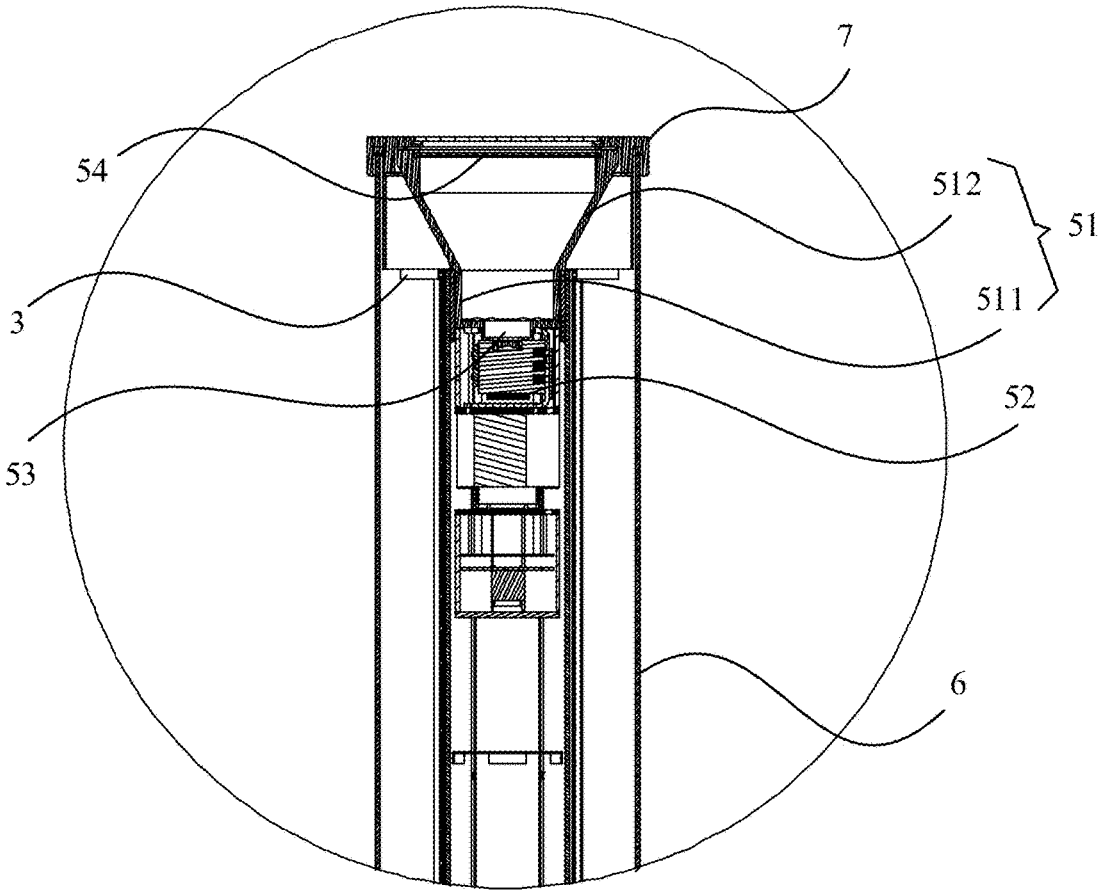
FIG. 12 is an enlarged diagram of part D of FIG. 11.
Figure 13:
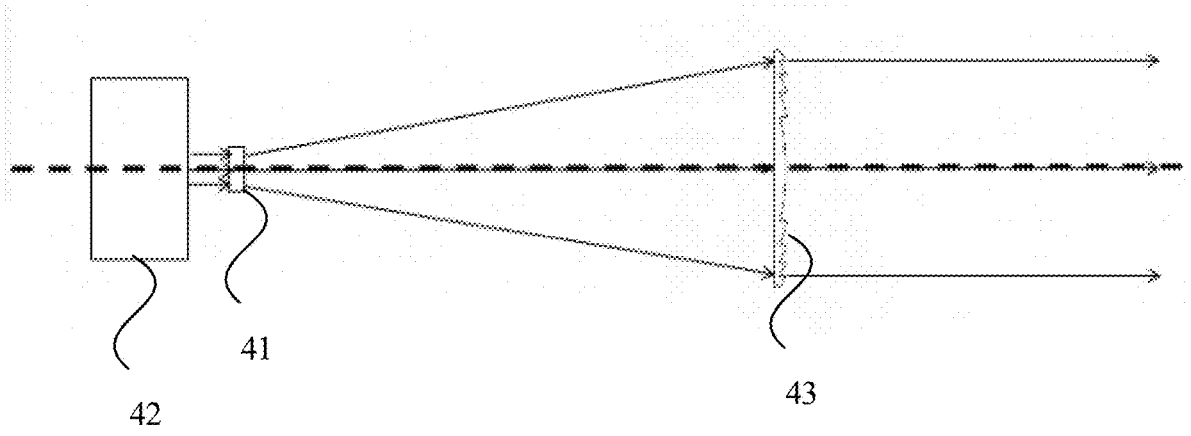
FIG. 13 is a light path diagram of a second light source module provided by an example of the present disclosure.

As shown in FIGS. 11-13, the second light source module 5 is configured to emit a light beam extending outward along the axis of the support column 1. The light beam generated by the second light source module 5 may be a parallel light beam, and of course may also have a certain diffusion angle. The diffusion angle may be set according to requirements, and an emitting distance of the parallel beam may reach more than 2000 meters. By setting the second light source module 5, the light-emitting pattern of the lighting fixture is further increased, and may be used as the lighting fixture to better meet the use demand. A ratio of the emitting distance of the parallel beam to a height of the lighting fixture may be greater than 1000 times.

The second light source module 5 includes a housing 51 fixed to the support column 1, and a second light source 52, a beam expanded lens 53, and a collimating lens 54 respectively arranged in the housing 51. The beam expanded lens 53 is located between the second light source 52 and the collimating lens 54. The top end of the housing 51 is approximately flush with the top end of the face mask 6.

As shown in FIGS. 11-13, the light beam generated by the second light source module 5 may be a parallel beam and of course may also have a certain diffusion angle. The diffusion angle may be set according to requirements. The emitting distance of the parallel beam may reach more than 2000 meters. The second light source module 5 includes the housing 51 fixed to the support column 1, and the second light source 52, the beam expanded lens 53, and the collimating lens 54 respectively arranged in the housing 51. The beam expanded lens 53 is located between the second light source 52 and the collimating lens 54.

The housing 51 includes a first housing part 511 located in a through hole of the support column 1, a second housing part 512 located outside the support column 1, and a light-emitting surface provided on the second housing part 512. The first housing part 511 is substantially cylindrical. The outer side of the first housing part 511 is provided with the threads. The first housing part 511 is screwed on the connection sleeve 2 via the threads. The second housing part 512 is substantially conical. A circuit board 3 fixed to the top end 11 of the support column 1 has a ring shape, and the second housing part 512 passes through the circuit board 3.

The second light source 52 and the beam expanded lens 53 are arranged in the first housing part 511. The collimating lens 54 is arranged in the second housing part 512. A collimating beam (a smaller diameter) emitted by the second light source 52 is expanded to a diameter (a larger diameter) of an object via the beam expanded lens 53, and then collimated by the collimating lens 54 to obtain a collimated beam with a target diameter. After passing through the beam expanded lens 53 and the collimating lens 54, the light beam generated by the second light source module 5 has a diameter larger than that of the light-emitting surface of the second light source module 5. The beam expanded lens 53 may be a right (a right side close to the collimating lens 54) plane-left concave lens. The collimating lens 54 may be a Fresnel lens. A heat sink and the like may also be provided in the first housing part 511.

As shown in FIG. 1, the face mask 6 is substantially cylindrical and sleeved on the outer side of the support column 1. The face mask 6 has a length longer than a length of the support column 1. After the face mask 6 is sleeved on the outer side of the support column 1, the bottom end 12 of the face mask 6 is approximately flush with the bottom end 12 of the support column 1, and the top end of the face mask 6 is approximately flush with the top end of the housing 51.

The lighting fixture further includes a sealing cover 7 arranged on the outer side of the second light source module 5. The lighting fixture is sealed by the sealing cover 7 to improve the sealing effect of the lighting fixture. The sealing cover 7 includes a top wall at the top end of the second light source module 5 and a side wall between the second housing part 512 and the face mask 6. The top wall of the sealing cover 7 covers the outer side of the second light source module 5. The side wall of the sealing cover 7 is provided with a screw hole and screwed on the face mask 6 via the screw to facilitate maintenance, disassembly and assembly.

Figure 14:
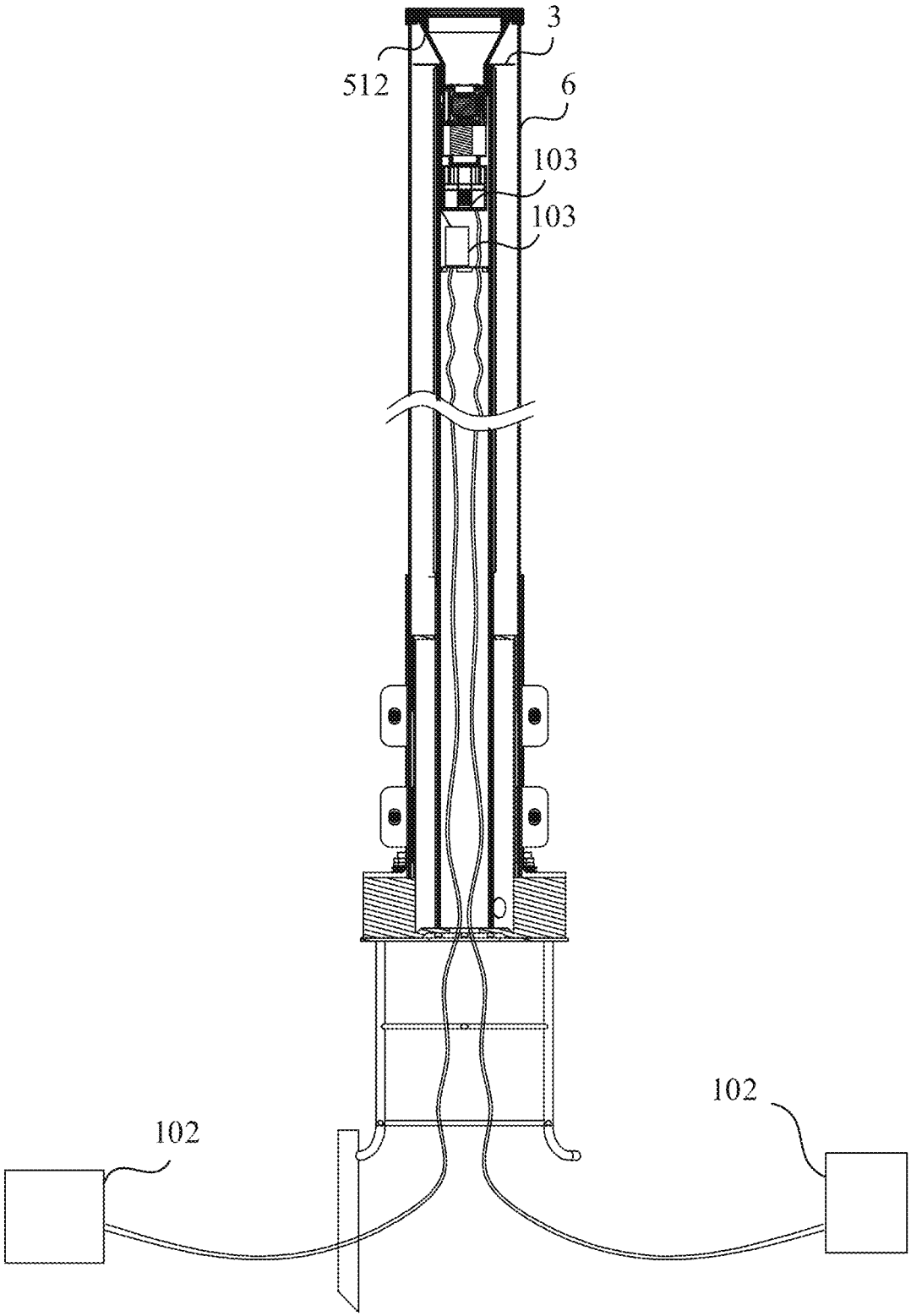
FIG. 14 is an arrangement structural schematic diagram of a light source board and a switch provided by an example of the present disclosure.

As shown in FIG. 14, the lighting fixture further includes a light source board 3 arranged at the top end 11 of the support column 1. The second housing part 512 passes through the middle of the light source board 3. One surface of the light source board 3 facing the sealing cover 7 is provided with LED light beads. The LED light beads of the light source board 3 emit light toward the top end of the face mask 6. The light source board 3 illuminates the face mask 6 between the sealing cover 7 and the first light source module 4 to further improve the uniformity of light on the face mask 6.

Figure 15:
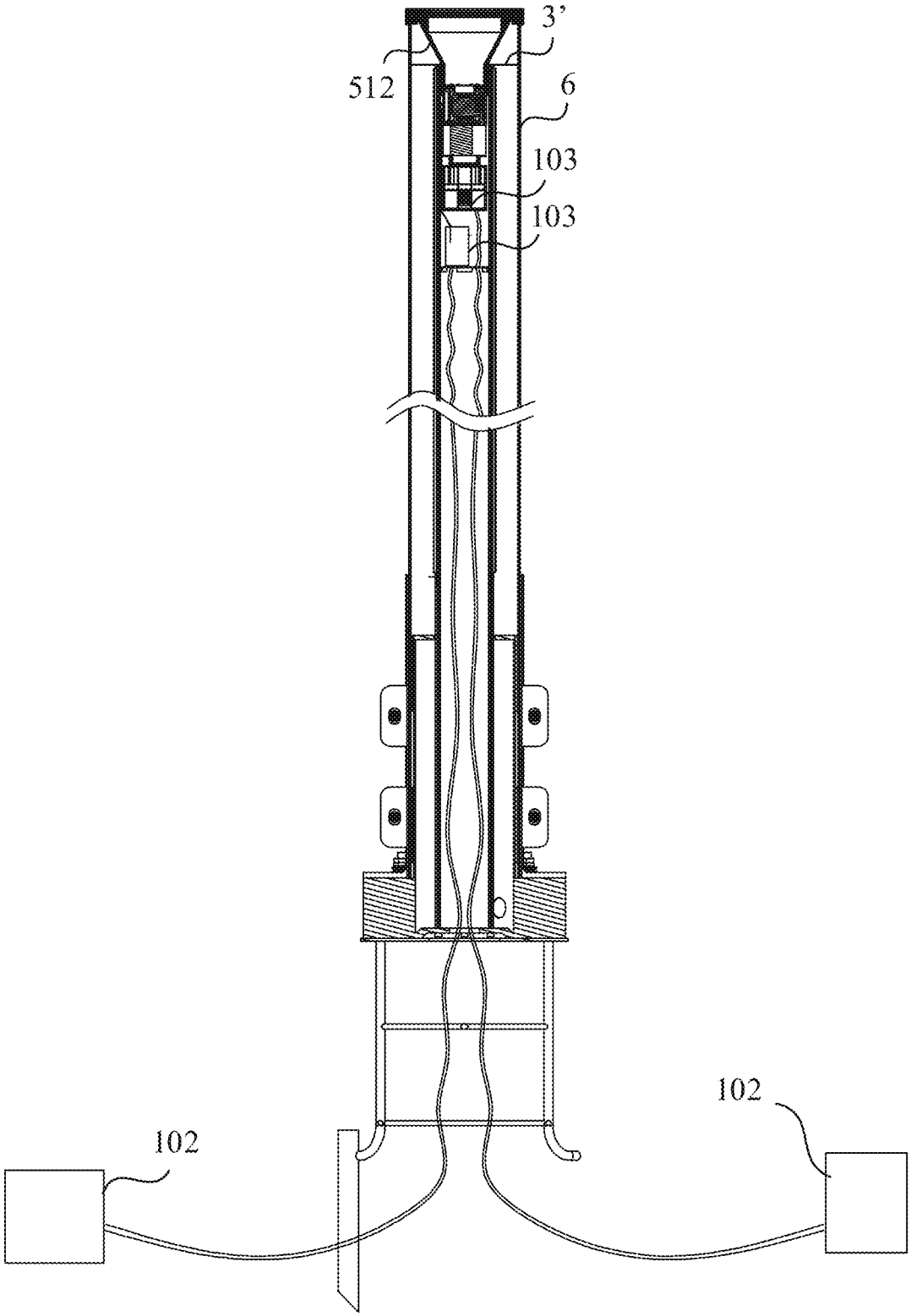
FIG. 15 is an arrangement structural schematic diagram of a shading board and a switch provided by an example of the present disclosure.

As shown in FIG. 15, a shading board 3' instead of the light source board 3 may be provided on the lighting fixture. The light-shielding board 3' is arranged at the top end 11 of the support column 1. The second housing part 512 passes through a middle of the light-shielding board 3' and is in contact with the light-shielding board. An outer side of the light-shielding board 3' is in contact with the face mask 6. The light shielding board 3' shields the side wall of the lighting fixture between the sealing cover 7 and the first light source module 4, so as to prevent light emitted by the first light source module 4 from gradually darkening in this part and affecting the uniformity of side wall light.

As shown in FIGS. 14 and 15, the first light source module 4 and the second light source module 5 may be controlled by different switches 102, so that the first light source module 4 and the second light source module 5 may be turned on or off respectively as needed. The first light source module 4 and the second light source module 5 may be respectively connected to different drivers 103 via a wire to facilitate the setting of a driver 103. The light source board 3 and the first light source module 4 are controlled by the same switch 102.

Figure 16:
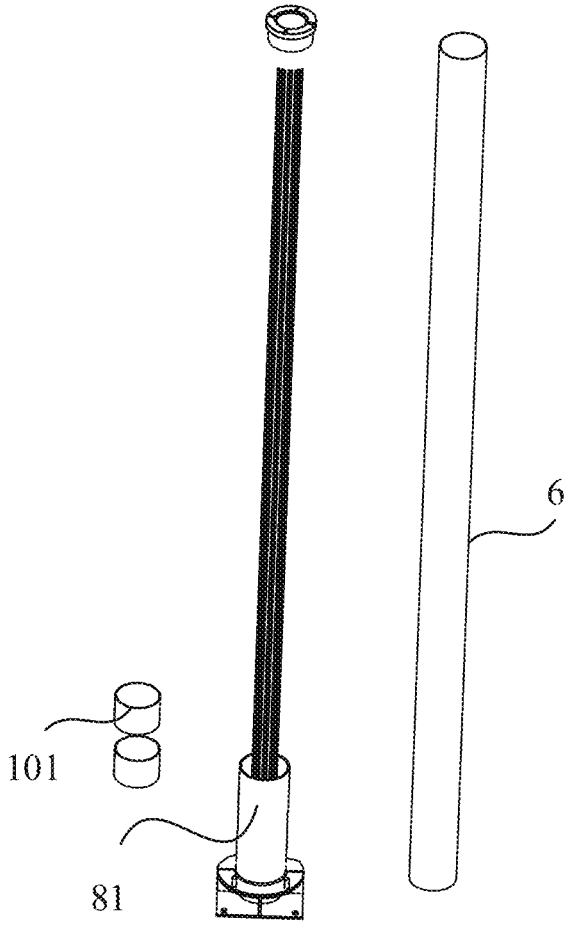
FIG. 16 is a schematic diagram of installation of a fixing base provided by an example of the present disclosure.
Figure 17:
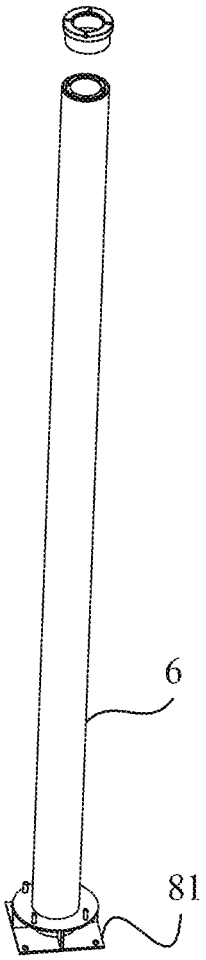
FIG. 17 is a schematic diagram of installation of a face mask provided by an example of the present disclosure.
Figure 18:
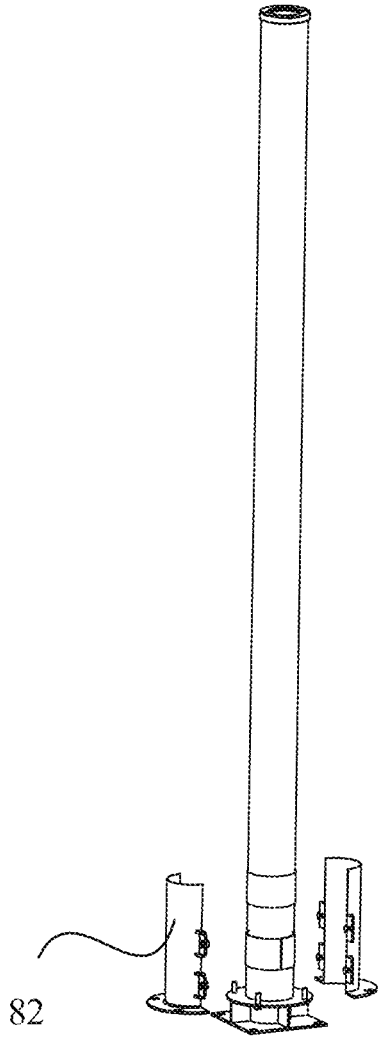
FIG. 18 is a schematic diagram of installation of a clamping base provided by an example of the present disclosure.

As shown in FIG. 2, the lighting fixture further includes a lampstand 8 through which the lighting fixture is fixed on an embedded member 9 on the ground. The lampstand 8 is assembled on the support column 1 and located at the bottom end 12 of the support column 1. As shown in FIGS. 16 to 18, the lampstand 8 includes a fixing base 81 arranged on the outer side of the first light source module 4 and a clamping base 82 arranged on an outer side of the fixing base 81. The face mask 6 is located between the fixing base 81 and the clamping base 92, and a rubber pad 101 is provided between the face mask 6 as well as the fixing base 81 and the clamping base 82.

The present disclosure may include dedicated hardware implementations such as application specific integrated circuits, programmable logic arrays and other hardware devices. The hardware implementations can be constructed to implement one or more of the methods described herein. Examples that may include the apparatus and systems of various implementations can broadly include a variety of electronic and computing systems. One or more examples described herein may implement functions using two or more specific interconnected hardware modules or devices with related control and data signals that can be communicated between and through the modules, or as portions of an application-specific integrated circuit. Accordingly, the system disclosed may encompass software, firmware, and hardware implementations. The terms "module," "sub-module," "circuit," "sub-circuit," "circuitry," "sub-circuitry," "unit," or "sub-unit" may include memory (shared, dedicated, or group) that stores code or instructions that can be executed by one or more processors. The module refers herein may include one or more circuit with or without stored code or instructions. The module or circuit may include one or more components that are connected.

The above descriptions are only examples of the present disclosure and are not intended to limit the present disclosure. For those skilled in the art, various modifications and variations are possible. Any modification, equivalent replacement, improvement, etc. made within the spirit and principle of the present disclosure shall be included in the protection scope of the present disclosure.

What is claimed is:

1. An outdoor lighting fixture comprising: a support column comprising a top end, a bottom end, and a side wall between the top end and the bottom end; a plurality of groups of first light source modules provided along a circumferential direction of the support column and extending along an axis of the support column assembled on an outer side of the side wall of the support column and configured to emit light laterally; a face mask covering an outer side of the first light source module; wherein the face mask has a length longer than a length of the support column, and a sealing cover is on the top end of the fast mask, wherein a top wall of the sealing cover covers the top end of the face mask and a side wall of the sealing cover is inside the face mask and is connected to the face mask, and the side wall of the sealing cover is provided with a screw hole to screw the sealing cover on the face mask, and a second light source module assembled on the top end of the support column and configured to emit a light beam through an opening of the sealing cover extending outward along the axis of the support column.

2. The outdoor lighting fixture according to claim 1, wherein the first light source module comprises a substrate on the support column and a first light source on the substrate, and both the substrate and the first light source extend along a direction from the top end to the bottom end of the support column.

3. The outdoor lighting fixture according to claim 2, wherein the substrate of each first light source module is planar or in a curved shape around the support column.

4. The outdoor lighting fixture according to claim 3, wherein the first light source module further comprises a diffuser on an outer side of the first light source, the diffuser extends along the direction from the top end to the bottom end of the support column, and diffused light produced by the diffuser extends along the circumferential direction of the support column.

5. The outdoor lighting fixture according to claim 3, wherein:

a distance between center lines of two adjacent groups of first light sources is denoted as D, a distance between a center line of the first light source and the face mask is denoted as H, and $H \geq 1.4D$; and a deflection angle of the two adjacent groups of first light sources is denoted as $\alpha$, a light-emitting angle of the first light source module is denoted as $\beta$, and $\beta \geq 120° + \alpha$.

6. The outdoor lighting fixture according to claim 2, wherein a snap-fit portion extending along the direction from the top end to the bottom end of the support column is on the support column, and the substrate is inserted into the snap-fit portion from an end of the snap-fit portion and locked in the snap-fit portion.

7. The outdoor lighting fixture according to claim 1, wherein the second light source module comprises a housing fixed to the support column, and a second light source, a beam expanded lens and a collimating lens that are respectively in the housing, and the beam expanded lens is between the second light source and the collimating lens.

8. The outdoor lighting fixture according to claim 7, wherein the housing comprises a first housing part fixed inside the support column and a second housing part outside the support column, the second light source and the beam expanded lens are fixed on the first housing part, and the collimating lens is fixed on the second housing part.

9. The outdoor lighting fixture according to claim 8, further comprising:

a light source board on the top end of the support column and emitting light toward the second light source module, and the second housing part passing through a middle of the light source board; or a light-shielding board on the top end of the support column, the second housing part passing through a middle of the light-shielding board and being in contact with the light-shielding board, and an outer side of the light-shielding board being in contact with the face mask.

10. The outdoor lighting fixture according to claim 8, further comprising a sealing cover arranged outside the second light source module, wherein the sealing cover is fixed on the face mask.

11. The outdoor lighting fixture according to claim 1, further comprising a lampstand assembled at the bottom end of the support column.

12. The outdoor lighting fixture according to claim 11, wherein the lampstand comprises a fixing base fixed on the support column and a clamping base outside the fixing base, and the face mask is pressed between the fixing base and the clamping base.

13. The outdoor lighting fixture according to claim 1, wherein the first light source module and the second light source module are respectively electrically connected to different switches.

14. A lighting fixture comprising: a support column comprising a top end, a bottom end, and a side wall between the top end and the bottom end; a first light source module, assembled on an outer side of the side wall of the support column comprising a substrate and a plurality of first light sources arranged on the substrate in a plurality of columns, wherein the columns of first light sources are arranged along a circumferential direction of the support column and extend along a direction from the top end to the bottom end of the support column; and a face mask covering an outer side of the first light source module, wherein the face mask has a length longer than a length of the support column, and a sealing cover is on the top end of the fast mask, wherein a top wall of the sealing cover covers the top end of the face mask and a side wall of the sealing cover is inside the face mask and is connected to the face mask, and the side wall of the sealing cover is provided with a screw hole to screw the sealing cover on the face mask, and the plurality of columns of first light sources are configured to emit light laterally toward the face mask; and a second light source module assembled on the top end of the support column and configured to emit a light beam through an opening of the sealing cover extending outward along an axis of the support column.

15. The lighting fixture according to claim 14, wherein:

a distance between normal lines of two adjacent columns of first light sources is denoted as D, a distance between a normal line of each column of first light sources and the face mask is denoted as H, and $H \geq 1.4D$; and a deflection angle of the light emitting surface of two adjacent columns is denoted as $\alpha$, a beam angle of light emitting surface of each column when viewed from a top of the columns is denoted as $\beta$, and $\beta \geq 120° + \alpha$.

16. The lighting fixture according to claim 15, wherein:

the substrate is planar, and a plurality of substrates are provided at an interval along the circumferential direction of the support column, and each substrate is respectively provided with one column of first light sources;

wherein a plurality of snap-fit portions extending in the direction from the top end to the bottom end of the support column are provided on the support column, and respective substrates are inserted into the plurality of snap-fit portions from ends of different snap-fit portions respectively and locked in the plurality of snap-fit portions; and the first light source module further comprises a plurality of optical elements respectively covering outer sides of respective columns of first light sources, and each of the plurality of optical element extends in the direction from the top end to the bottom end of the support column.

17. The lighting fixture of claim 15, wherein the substrate is in a curved shape around the support column.

18. The lighting fixture according to claim 14, wherein a maximum range of angle in which a maximum projection of a field of emission intersects with a projection of a normal line of an adjacent column of first light sources on the face mask does not exceed 5 degrees.

19. The lighting fixture according to claim 14, wherein:

a top end of the face mask extends beyond the support column and the first light source module;

the lighting fixture further comprises a light source board which is on the top end of the support column and emits light toward the top end of the face mask, or, the lighting fixture further comprises a light-shielding board on the top end of the support column and an outer side of the light-shielding board is in contact with the face mask; and the light source board and the first light source module are connected to a same switch.

20. The lighting fixture according to claim 14, further comprising a lampstand assembled at the bottom end of the support column.

* * * * *